US006574830B2

(12) United States Patent
Huddleston

(10) Patent No.: US 6,574,830 B2
(45) Date of Patent: Jun. 10, 2003

(54) VACUUM OPERATED CLEANING ACCESSORY WITH ROLLER BRUSH

(76) Inventor: Michael D Huddleston, P.O. Box 6003, Reno, NV (US) 89513

( * ) Notice: Subject to any disclaimer, the term of this patent is extended or adjusted under 35 U.S.C. 154(b) by 0 days.

(21) Appl. No.: 09/912,508

(22) Filed: Jul. 23, 2001

(65) Prior Publication Data

US 2003/0014832 A1 Jan. 23, 2003

(51) Int. Cl.[7] ..... A47L 9/02

(52) U.S. Cl. ..... 15/388; 15/398; 15/414; 15/25

(58) Field of Search ..... 15/388, 395, 398, 15/414, 25, 26, 27, 144.1, 246.2, 383, 24; 134/21

(56) References Cited

U.S. PATENT DOCUMENTS

| | | | | | |
|---|---|---|---|---|---|
| 336,842 | A | * | 2/1886 | Curtin | 15/25 |
| 518,352 | A | * | 4/1894 | Nightingale | 15/24 |
| 962,569 | A | * | 6/1910 | Hirth | 15/388 |
| 1,045,368 | A | * | 11/1912 | Bourne | 15/144.1 |
| 1,694,257 | A | * | 12/1928 | Hagopian | 15/395 |
| 1,982,910 | A | * | 12/1934 | Forbes et al. | 15/144.1 |
| 2,039,052 | A | * | 4/1936 | Beck et al. | 15/160 |
| 2,396,862 | A | * | 3/1946 | Linderoth | 15/388 |
| 2,573,201 | A | * | 10/1951 | Kelley et al. | 15/388 |
| 2,635,268 | A | * | 4/1953 | Pettie | 15/25 |
| 2,723,407 | A | * | 11/1955 | Bardon | 15/24 |
| 4,363,157 | A | * | 12/1982 | McGrath | 15/388 |
| 5,960,514 | A | * | 10/1999 | Miller et al. | 15/388 |
| 5,987,682 | A | * | 11/1999 | Rossi | 15/24 |
| 6,021,546 | A | * | 2/2000 | Tyma | 15/388 |
| 6,026,541 | A | * | 2/2000 | Bailey et al. | 15/414 |

* cited by examiner

*Primary Examiner*—Theresa T. Snider
(74) *Attorney, Agent, or Firm*—Sierra Patent Group, Ltd.

(57) ABSTRACT

A vacuum cleaner accessory that is used in cleaning heat exchanger units for heating and cooling machinery, wherein the invention comprises of a wand-like body forming an interior that is continuously connected at a rear open end with a vacuum source and at a front open end has an aperture which allows the interior of the device to meet the exterior environment. The unattached front open end has at least one prong-like extension upon which a brush is movably attached and is held in close proximity to the aperture.

In operation, the vacuum source is applied to the device and the brush of the device is applied to and rolled over the surface of the heat exchanger unit to be cleaned. The rolling action of the brush agitates and removes particulate matter that has settled upon and coated the surface of the heat exchanger unit. As the particulate matter is removed from the surface of the heat exchanger by the brush, the air being drawn into the aperture by means of the applied vacuum, brings with it the removed particulate matter and alike into the interior of the device and removes the particulate matter and alike to area of containment remote from the heat exchanger until such time that the waste matter is properly disposed of by the operator.

12 Claims, 5 Drawing Sheets

1
10
12
14
15
14
24
25
11

VACUUM OPERATED CLEANING ACCESSORY WITH ROLLER BRUSH

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND

1. Field of the Invention

The present invention relates to the field of vacuum-based cleaning attachments, in particular to those utensils which utilize roller brushes.

2. Description of the Related Art

The art of vacuum cleaner attachments is as old and varied as the art relating to vacuum cleaners themselves. Vacuum cleaners generally come as two types: a pure vacuum suction unit commonly referred to a shop vacuum. This device generally relies on a fan-based vacuum to use suction to remove dirt and other unwanted particulate matter from the surface being cleaned. Roller brush-based vacuum cleaners on the other hand, combine a powered rotary brush to agitate the cleaning surface and to release dirt with a fan-induced vacuum to remove the dirt into the containment of the vacuum cleaner.

Many of the shop type vacuums and the roller brush vacuums utilize reversibly connectable attachments for specialized cleaning functions. These attachments generally connected to the vacuum cleaner so to be powered by the suction vacuum that the vacuum cleaner produces. Generally speaking, these vacuum cleaner attachments are in a wand-shape configuration and feature a tube construction in which the body of the attachment is shaped to allow the attachment access to areas that the vacuum cleaner could not ordinarily reach.

One area of this prior art which has not been properly addressed is in reference to the specialized cleaning of heat exchanger units for heating/cooling apparatuses. Heat exchanger units are the heat transferring component of heating and cooling systems which move heat from one environment to another environment of the heating and cooling system. For refrigeration, air-conditioning or other cooling systems, the heat exchanger is generally a coiled pattern of continuous tubing in which heated refrigerant or coolant is passed. The heated refrigerant/coolant, by passing though the interior of the tubing, transfers its heat to the structure of the tubing itself. The tubing, which is constructed to be very receptive to heat transfer (i.e.; metal tubing), transfers the heat from its interior to its outside surface. There, the external environment, either water or air, surrounding the outside of the tubing, absorbs the heat from the tubing. In this manner, the heat exchanger transfers the heat to effect the cooling of the refrigerant/coolant.

The heat exchangers for heating units are generally situated not in the outside environment but within the heating device itself. For example, a heating boiler has the heat exchanger built into the boiler where hot combustion gases pass though the inside of tubing (flue tubing) to transfer heat to the boiler water. This heated boiler water is then circulated to radiators situated though out the building being heated.

Another example of a heating unit's heat exchanger would be for forced air heaters. In this instance, the hot air from the combustion chamber of the furnace flows through the inside the tube (flue tube) to heat the forced air that is surrounding the flue tubes. The heated forced air is then dispersed though out the building being heated.

If the surface of the heat exchanger through which the forced air or heated gas comes into contact are not kept clean, the functioning and efficiency of the heat exchanger could be seriously impacted. For example, the heat exchanger for hermetic refrigerant-based cooling systems transfers heat accumulated by the refrigerant to the outside environment when the refrigerant is compressed from a gas into a liquid state by the refrigerator's compressor. This heat exchanger releases the heat to the ambient air surrounding the heat exchanger to dissipate the heat to the surrounding environment. If airborne particulate matter, such as dust, coats or otherwise accumulates on the outside surface of the cooling coiling of the heat exchanger, the heat exchanger unit would be unable to effectively transfer the heat from the refrigerant/coolant. The refrigeration unit, to make up for this loss of heat transfer efficiency would increase the running time of refrigerator's cooling cycle. This reaction increases the wear and tear on the compressor system, as well as, unnecessarily increases the operational costs. This situation also holds true for non-hermetically sealed/non-compression cooling systems as well, in that they too will make up for increased heat exchanger inefficiency by running longer and have the same types of increases in cost.

For heating systems, the combustion gas tubes (flue tubes) become coated with the particulate matter resulting from the burning of carbonaceous fuels that are used to heat the air or water on the outside surfaces of the heat exchangers. If such coating by the particulate matter is not regularly removed as part of normal maintenance, it will act as insulation to prevent effective heat transfer by the heat exchanger. The system, to make up for this heat loss, will run longer causing unnecessary wear and tear on the machinery and increase operational costs.

Today, such heat exchanger cleaning is accomplished with brushes and scrapers to effect removal of particulate matter from the surfaces of the heat exchanger. A problem for this type of removal is that particulate matter is easily disturbed and scattered. The scattered particulate matter will float through the air to nearby objects to contaminate their surfaces. Worse, the airborne particulate matter can be breathed in by the cleaners and others in the nearby vicinity. While this might not be a significant risk for the "once-a-year" cleaner, it could pose significant respiratory and related health problems for the professional who regularly cleans and maintains such machinery.

What is needed therefore is a vacuum cleaner powered accessory that can universally connect to and be powered by a wide variety of vacuum cleaners and vacuum cleaner systems to effectively clean the air contact surfaces of heat exchanger units. The accessory should quickly remove and then contain within the vacuum cleaner, the particulate matter for easy and clean disposal. This would prevent the particulate matter during the removal process from contaminating surfaces of other objects and posing a health hazard to individuals.

SUMMARY OF THE INVENTION

The invention is a vacuum cleaner accessory which is comprised of a hollow tube with two open ends, front and back. The back open end provides for universal, quick, reversible attachment to the vacuum system while the front open end of the tube moveably mounts a roller brush in front of the aperture located at the front open end. In the preferred embodiment of the invention, two prongs, in a fork-like appearance, extend forward from the front open end. A roller brush is rotatably suspended between the prongs and held in front of the aperture.

For use in cleaning the outside portions of the coils of a heat exchanger, the brush would be cylindrical shaped.

For use in cleaning the inside surface of a tube of the heat exchanger, the brush would be spherical-shaped. The diameters of both the body and the brush would be smaller than the inner diameter of the heat exchanger tubing.

In operation, the accessory by its back open end is attached to a vacuum system and the vacuum system is switched on. The operator places the brush end of the invention on the surface of the tubing/coil to be cleaned and pushes the device back and forth over the surface. The brush is manually pushed along and rotated to agitate and remove the particulate matter from the surface being cleaned. The close proximity of the brush to the vacuum operation of the front open end ensures that the "kicked up" particulate matter is sucked into the front open end and is properly removed by the vacuum cleaner/system. In this manner, the vacuum suction prevents the vast majority of agitated particulate matter from escaping into the open environment where it could contaminate other objects or cause health problems to nearby personnel.

It is an object of the present invention to provide a simple, low cost, easy to construct vacuum operated cleaning device that removes and contains particulate matter that when agitated can become airborne and disperse to contaminate persons and to soil other surfaces of other items not being cleaned.

It is an object of the present invention to provide an apparatus and methodology of cleaning and containing for particulate surface contaminants.

It is an object of the present invention to provide a means of improving the efficiency of heat exchanger units of heating and cooling systems.

It is an object of the present invention to provide means and methodology for reducing exposure of inhalation of particulate contaminants by professionals servicing heat exchangers of heating-cooling units.

It is an object of the invention to provide a device that can be operated in narrow or otherwise confined spaces.

It is an object of the invention to protect the operator from electrical shock when cleaning in an area that has electrically charged machinery or devices.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTIONS OF THE NUMBERING OF THE DRAWINGS

1 Invention
10 Body
11 Back Open End
12 Front Open End
13 Front Open End Aperture
14 Prong
15 Roller Brush
16 Central Axis
17 Vacuum Cleaner
20 Operator
21 Heat Exchanger
23 Flue Tube
24 Accordion Fold
25 Interior

DESCRIPTION OF PREFERRED EMBODIMENTS

Figure 1:
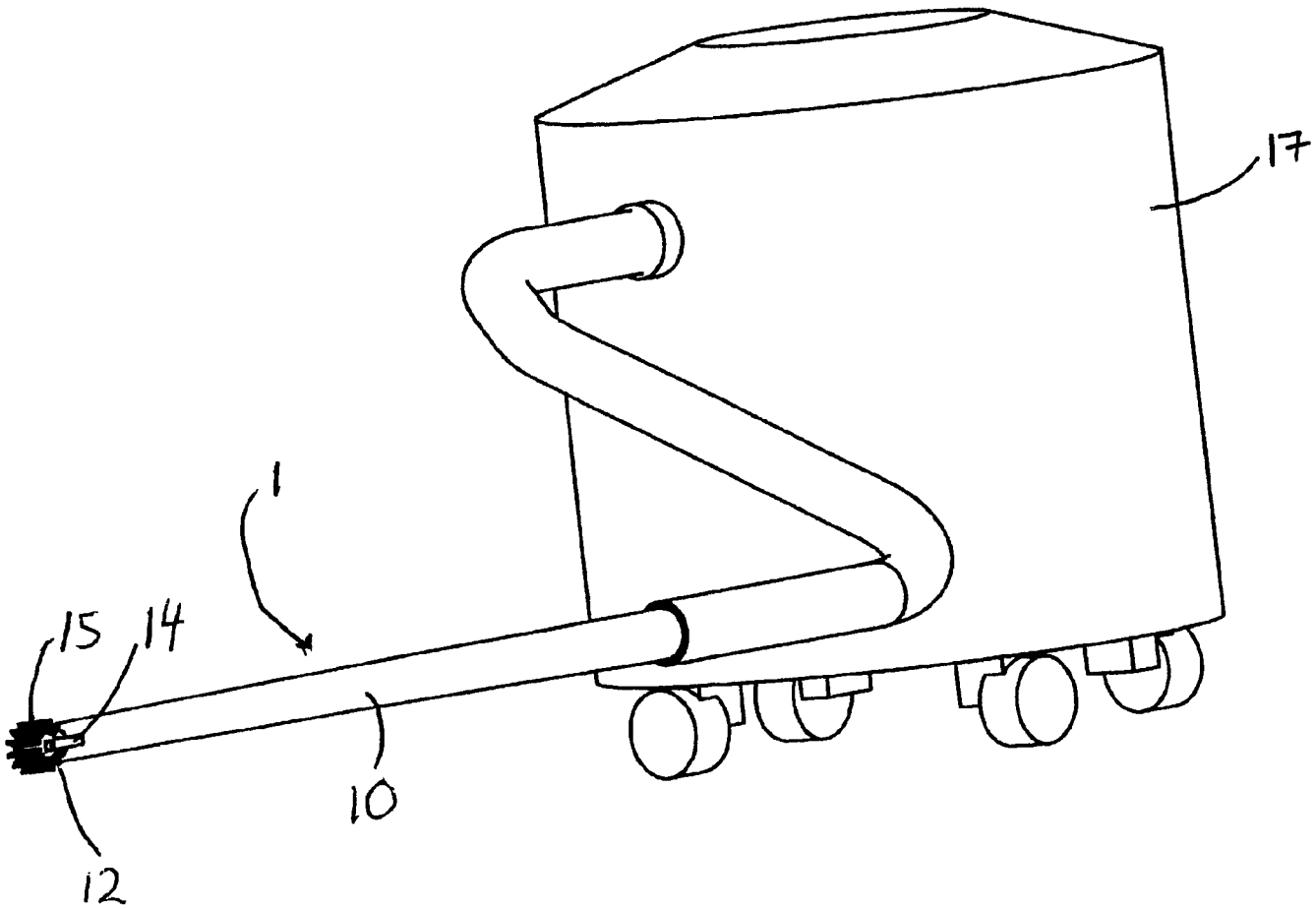
FIG. 1 A perspective view of the preferred embodiment
Figure 2:
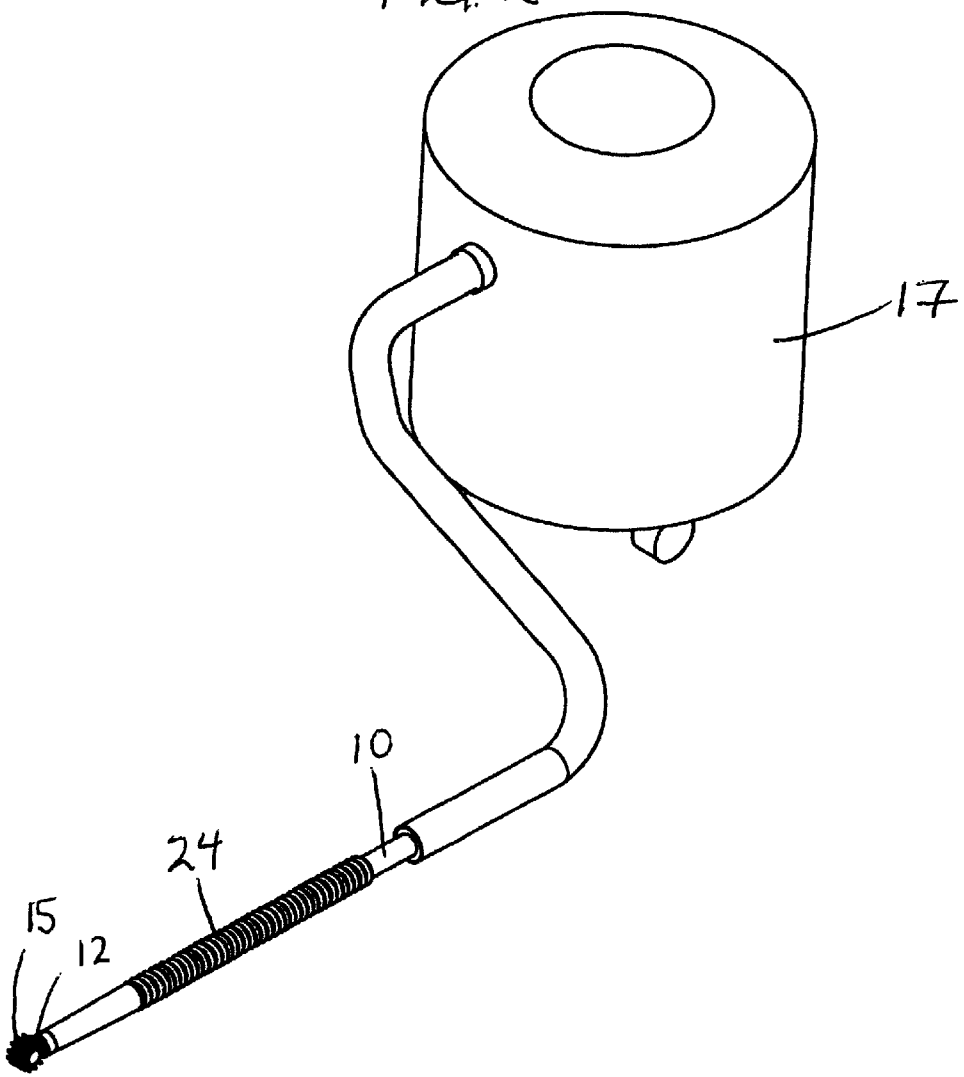
FIG. 2 A perspective view of the alternate embodiment
Figure 5:
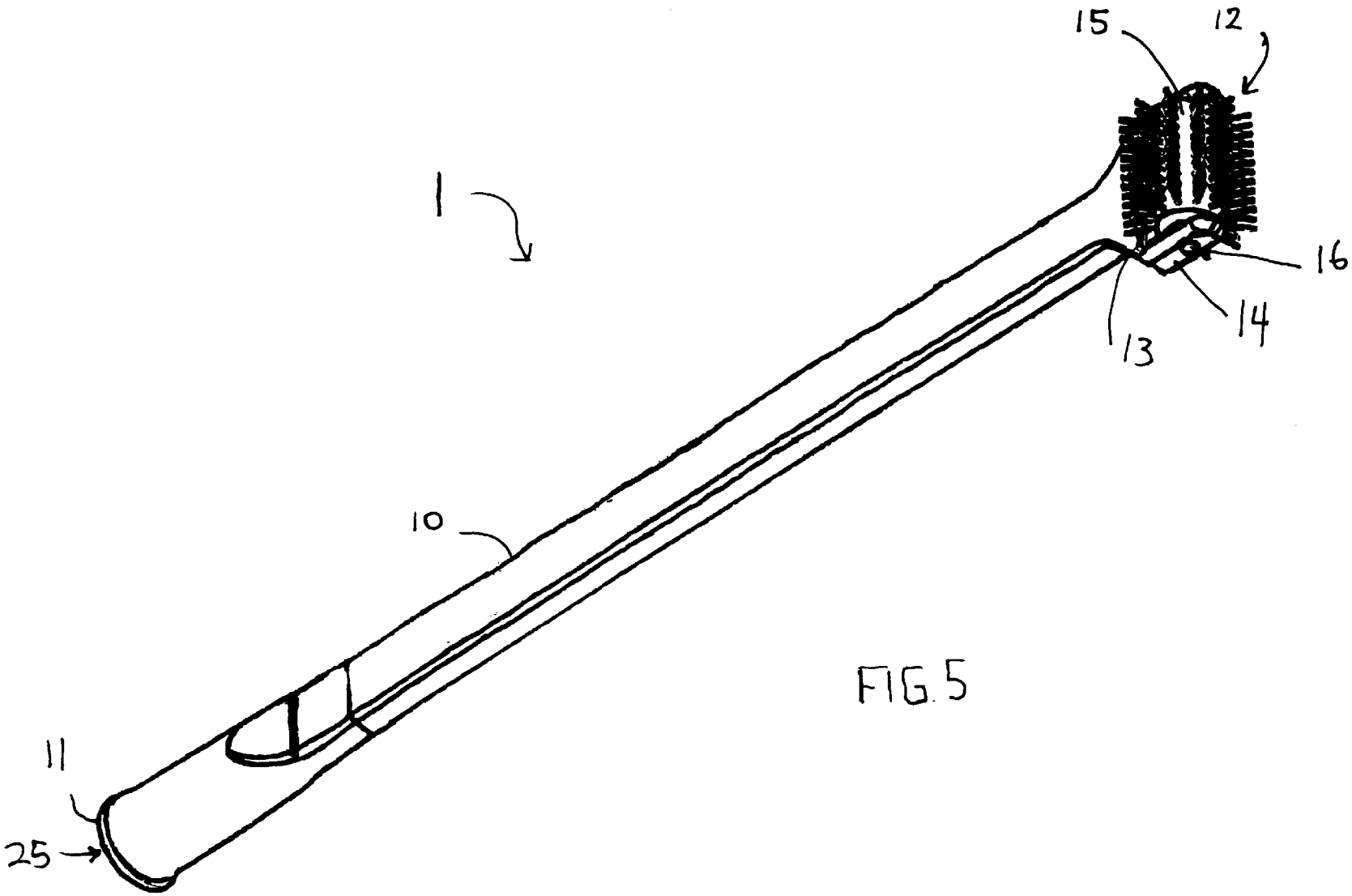
FIG. 5 A perspective view of an alternate embodiment

Now referring to FIGS. 1, 2 and 5, the invention, generally referenced as numeral 1, is a wand-like device comprising of a body 10, which has a tapered tube shape, with openings at each end. The opening at the back end of the tube is the back open end 11 and is constructed to have universal attachment capacity to vacuum cleaner systems. For most of these systems, attachment is accomplished by a reversible friction fit of the back end of a vacuum accessory to the connection aperture of a vacuum cleaner 17 or the flexible tube continuously connected to a vacuum cleaner 17. The design of such a universal coupling is well-known to one ordinarily skilled in the art. The universal attachment means is to apply essentially to portable shop vacuums, roller brush based vacuums, as well as to central vacuum systems.

The attachment of the back open end 11 to the vacuum means is to provide a continuous connection of the interior 25 of the invention 1 as formed by the body 10 with the interior portion of the vacuum means. The other end of the body 10 forms the front open end 12 which comprises an aperture 13 from whose sides two prongs 14 extends forward in parallel like those of a fork. Movably suspended between the ends of these two prongs is a roller brush 15 which is formed by bristles wrapped around a central axis 16. The ends of this central axis 16 are movable connected to depressions at the ends of the prong 14 to allow the roller brush 15 to movably rotate around its central axis 16. The roller brush 15 can be cylindrically shaped for cleaning the outside surface of a heat exchanger or it can be spherically-shaped for cleaning the inside tubes of a heat exchanger such as that for a hot water boiler (ie inside of flue tubes).

Figure 3:
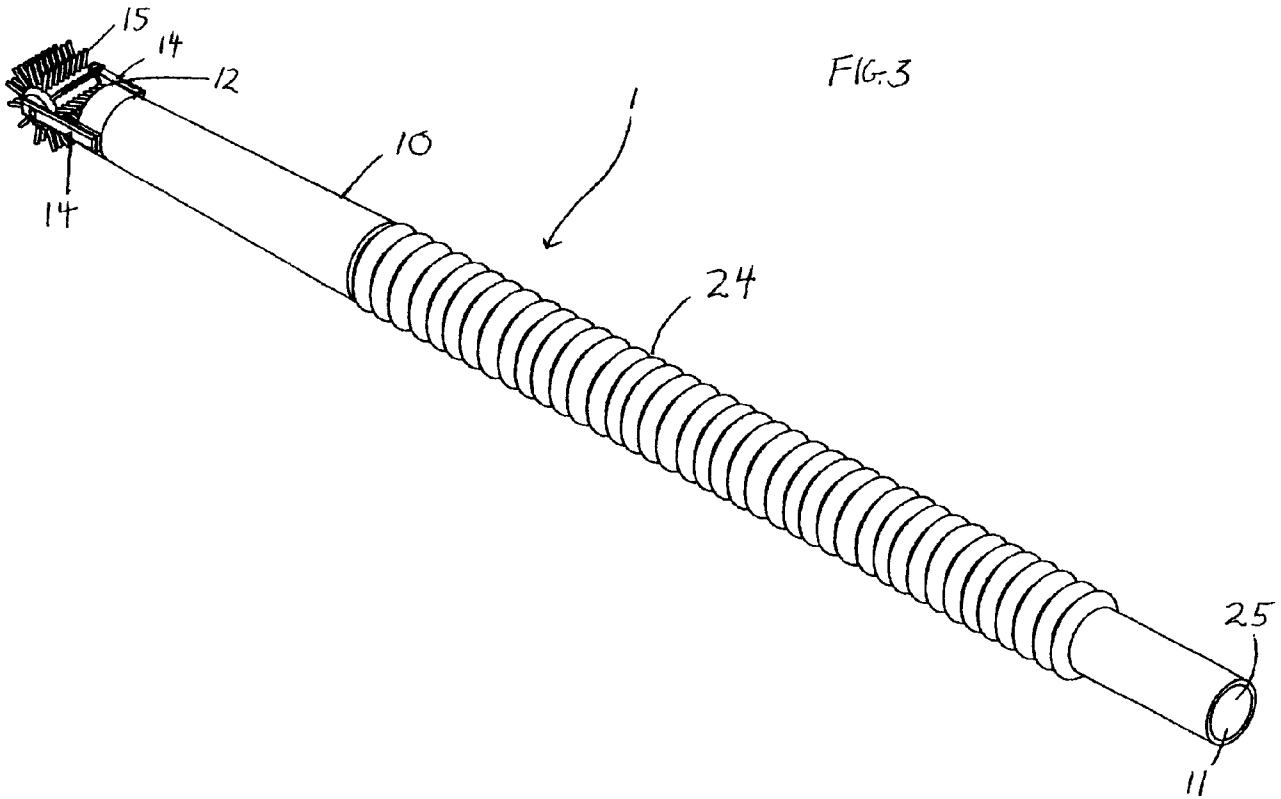
FIG. 3 A perspective view of the second alternative embodiment
Figure 4:
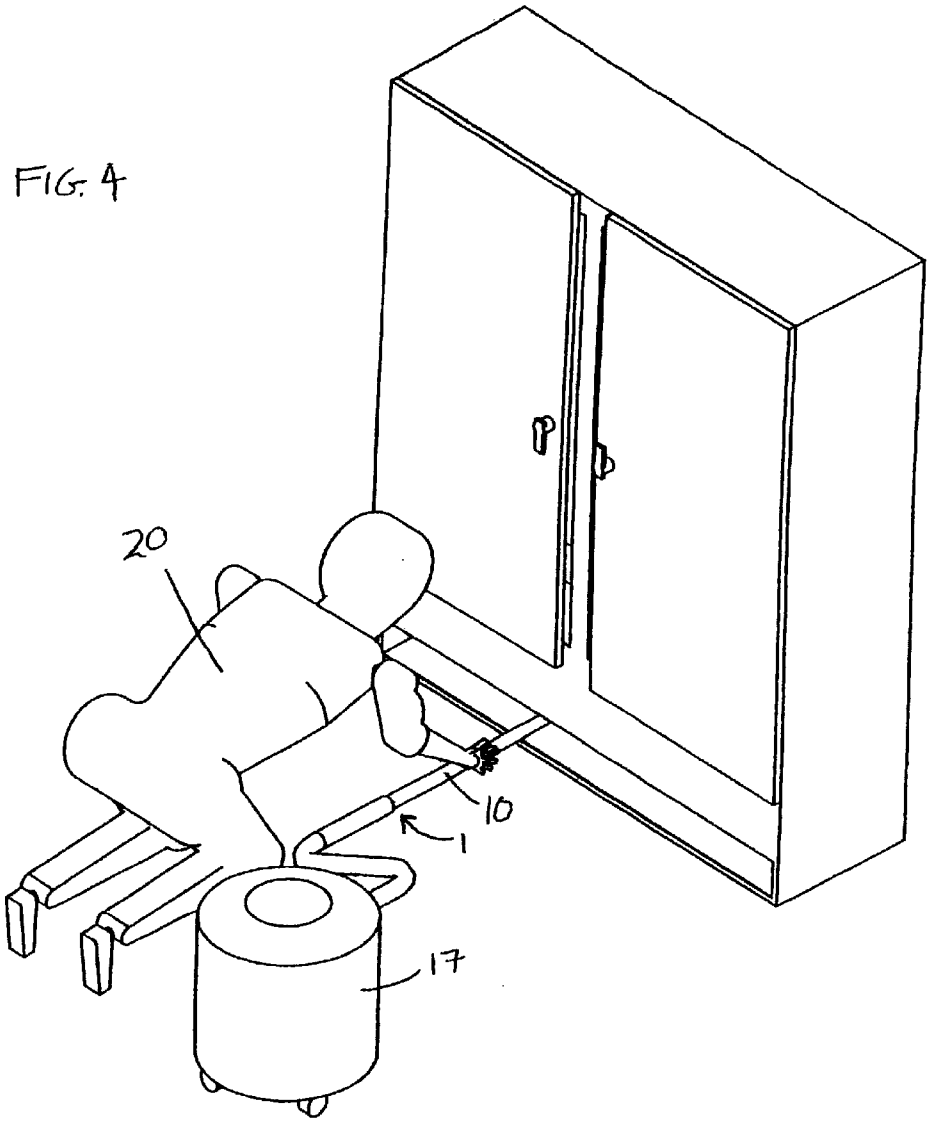
FIG. 4 An illustration showing the operation of the preferred embodiment

As shown in FIG. 3 an alternate embodiment of the invention 1, utilizes only one prong 14 which has an axle perpendicularly mounted on the end of the prong to face across the aperture of the front open end. The central axis 16 of the roller brush 15 is a hollow tube that movably fits over the axle to allow the roller brush 15 to rotate around the axle.

The manufacture of the preferred embodiment of the invention 1 is to have the invention 1 be made out of non-conductive material such as plastic, graphite fiber, fiberglass or made with a non-conductive coating such as plastic or other elastic polymer. This is to prevent electrocution of the operator 20 or damage to electrically operated equipment that is normally associated in the confined spaces where heat exchangers are located. Also the use of plastic construction is also preferred because the soft nature of the material prevents damage to the surfaces of the items that the invention 1 could come into contact.

The body 10 could be made through plastic injection methodology, while the roller brush 15 would be made through standard manufacture out of plastic bristles or other non-conductive bristles fixed to a plastic axis. If the particular use of the invention 1 is to be limited for use in a non-energized environment then the restriction of nonconductive construction materials can be alleviated to allow the use of conductive materials such as metals. Such an environment would include but not be limited to, a heat exchanger located in boilers.

The invention 1 could also be constructed in a variety of diameters and length to suit the application and area that it would be used on and in. For heat exchangers in boilers and furnaces that utilize flue tubes the diameter of the roller brush 15 and body 10 would have to be less than that of the flue tube. The length of the invention 1 would also have to be long enough to clean the inside of the tube. For this end, the body 10 could be constructed in sections which easily snap together for various length tubes or snap apart for ease of transport. The body 10 could also have accordion folds 24 to allow the flexible bending of the body 10 to fit into areas that are not easily accessible by straight body versions of the invention 1.

The method of use for the invention 1 would be the attachment of the back open 11 end of the body 10 to a vacuum source such as a vacuum cleaner 17 or centralized vacuum system. The vacuum cleaner 17 is switched on so that the vacuum is communicated through to the aperture 13. The operator 20 would then place the brush end of the device upon the surface to be cleaned and cause the roller brush 15 to roll so as to agitate and lift off the particulate matter that is on the surface of the object to be cleaned. The vacuum would then suck the lifted dirt into the front open end aperture through the interior of the body to the vacuum device remote from the surface being cleaned for storage until properly disposed at the operator convenience at a later time.

For the specific uses on cleaning a heat exchanger surface, the invention 1 is rolled via the brush over the surfaces of the coils of the heat exchanger to remove particulate matter. It could also be used for housekeeping purposes for clean surfaces of the area surrounding the heat exchanger as well as other remotely located devices or apparati. For heat exchangers found as a part of furnaces or boilers, the device would be inserted into the flue tubes of such devices to remove particulate matter such as creosote and general carbon compound build-up, the burnt particulate matters resulting from the combustion of carbonaceous fuel such as gas and oil by the furnace and boiler.

Although the present invention has been described with particular reference to certain preferred embodiments, variations, alterations, modifications of the present invention may be effected by one skilled in the field of art while remaining within the intent and scope of the following claims.

What is claimed is:

1. A vacuum operated cleaning accessory comprising:

a bendable body having a hollow interior, said hollow interior including a front open end and a back open end opposite thereof, said back open end being constructed to reversibly attach to a vacuum source wherein said hollow interior is connected to said vacuum source; and a roller brush movably attached to said front open end.

2. The accessory of claim 1 wherein said bendable body includes folds.

3. A vacuum operated cleaning accessory comprising:

a body having a hollow interior, said hollow interior including a front open end and a back open end opposite thereof, said back open end being constructed to reversibly attach to a vacuum source;

at least one prong extending forward from said front end; and a roller brush movably attached to said at least one prong.

4. The accessory of claim 3 further comprising:

an axle perpendicularly extending from said at least one prong; said roller brush being moveably disposed on said axle.

5. The accessory of claim 3 wherein said at least one prong includes a first forward projecting prong coupled to said front end and a second forward projecting prong coupled to said front end, said roller brush being moveably suspended between said first forward projecting prong and said second forward projecting prong.

6. A vacuum operated cleaning accessory comprising:

a bendable body having a hollow interior, said hollow interior including a front open end and a back open end opposite thereof;

at least one prong extending forward from said front end; and a roller brush movably attached to said at least one prong, wherein said bendable body and said roller brush are configured to clean inside of heat exchanger tubing.

7. The accessory of claim 6 wherein said bendable body includes accordion-like folds.

8. The accessory of claim 6 wherein said bendable body comprises electrically non-conductive materials.

9. The accessory of claim 6 wherein said bendable body is selected from the group consisting of polymer elastic, graphite based compounds and plastic.

10. A method of using a vacuum operated cleaning accessory, the vacuum operated cleaning accessory including a bendable body having a hollow interior, the hollow interior including a front open end and a back open end opposite thereof, at least one prong extending forward from said front end, and a roller brush movably attached to said at least one prong, the method comprising:

attaching the back open end to a vacuum source;

flexing the bendable body to access a surface to be cleaned; and applying the roller brush to said surface to be cleaned;

pulling air and particulate into the front open end using said vacuum source.

11. The method of claim 10 wherein said pulling air and particulate into the front open end using said vacuum source includes pulling air and particulate past said roller brush and said at least one prong extending forward from said front end.

12. The method of claim 10 wherein said applying the roller brush to said surface to be cleaned includes agitating said particulate matter, wherein said agitating said particulate matter renders said particulate matter airborne.

* * * * *